US006555772B1

(12) United States Patent
Chou

(10) Patent No.: US 6,555,772 B1
(45) Date of Patent: Apr. 29, 2003

(54) VIBRATION SWITCH

(76) Inventor: Tien-Ming Chou, No. 41, San-Hsi 5th St., Pei Dist., Taichung (TW)

( * ) Notice: Subject to any disclaimer, the term of this patent is extended or adjusted under 35 U.S.C. 154(b) by 0 days.

(21) Appl. No.: 09/971,423

(22) Filed: Oct. 5, 2001

(51) Int. Cl.[7] ..... H01H 35/14
(52) U.S. Cl. ..... 200/61.45 R; 200/61.48; 200/61.51
(58) Field of Search ..... 73/649, 652, 662, 73/504.12, 514.29, 514.38; 200/61.45 R, 61.45 M

(56) References Cited

U.S. PATENT DOCUMENTS 3,141,936 A * 7/1964 Boyle et al. ..... 200/61.53
3,300,603 A * 1/1967 Wakely ..... 200/61.45 R
5,134,255 A * 7/1992 Tetrault et al. ..... 200/61.45 R
5,141,229 A * 8/1992 Roundy ..... 200/61.53
5,565,664 A * 10/1996 Chen ..... 200/61.45 R
6,297,463 B1 * 10/2001 Hills ..... 200/61.45 M

* cited by examiner

*Primary Examiner*—Michael Friedhofer
(74) *Attorney, Agent, or Firm*—Akin Gump Strauss Hauer & Feld, L.L.P.

(57) ABSTRACT

A vibration switch includes an electric contact body which is movably disposed in an accommodation chamber of a housing in an upright direction. A biasing member holds and restrains the contact body from moving towards a lower inner wall surface of the housing. A switching unit includes a contact member extending into the chamber, and is placed in one of switch-on and switch-off states in response to movement of the contact body relative to the contact member as a result of an inertial force of the contact body when the housing is jerked to move upwards.

2 Claims, 5 Drawing Sheets

VIBRATION SWITCH

BACKGROUND OF THE INVENTION

1. Field of the Invention

This invention relates to a vibration switch, more particularly to a vibration switch with an electric contact body which is movable to engage or disengage from a contact member of a switching unit by means of a biasing member so as to place the switching unit in one of switch-on and switch-off states.

2. Description of the Related Art

Referring to FIG. 1, a conventional vibration switch 1, which is applied to a warning device or a step-counting device, is shown to include a metal swing shaft 101 which has a pivot end 102 mounted pivotally on a circuit board 105, and a swing end 103 with a metal head 104. A metal pad plate 106 is secured on the circuit board 105 adjacent to the head 104. A string-shaped biasing member 107 is connected to the swing shaft 101. When the switch is jerked by means of a force (F), the swing end 103 will swing to move the head 104 to punch the pad plate 106 so as to place the switch 1 in an on state. By virtue of the biasing action of the biasing member 107, the swing end 103 can swing back to remove the head 104 from the pad plate 106 so as to place the switch 1 in an off state. However, the swing shaft 101 is bulky, and has a relatively large number of components, thereby resulting in inconvenient carrying and packaging and manufacturing costs.

SUMMARY OF THE INVENTION

The object of the present invention is to provide a vibration switch which has a simple construction and compact size, and which can be fabricated at a relatively low cost.

According to this invention, the vibration switch includes a housing which is adapted to be mounted on a support in an upright direction. The housing has upper and lower inner wall surfaces which are spaced apart from each other in the upright direction, and a surrounding wall which is interposed between and which cooperates with the upper and lower inner wall surfaces to confine an accommodation chamber. An electric contact body is disposed in the accommodation chamber and is movable in the upright direction. The contact body has electrically conductive uppermost and lowermost ends opposite to each other in the upright direction. A biasing member has an engaging end which is disposed to engage one of the upper and lower inner wall surfaces, and a holding end which is disposed opposite to the engaging end and which holds the electric contact body such that the uppermost and lowermost ends are nearest to the upper and lower inner wall surfaces, respectively. By means of a biasing action against the weight of the electric contact body, the holding end restrains the electric contact body from moving towards the lower inner wall surface. A switching unit includes a contact member which is disposed to extend into the accommodation chamber such that the switching unit is placed in one of switch-on and switch-off states in response to movement of the electric contact body in the upright direction relative to the contact member as a result of an inertial force of the electric contact body when the housing is jerked to move upwards.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
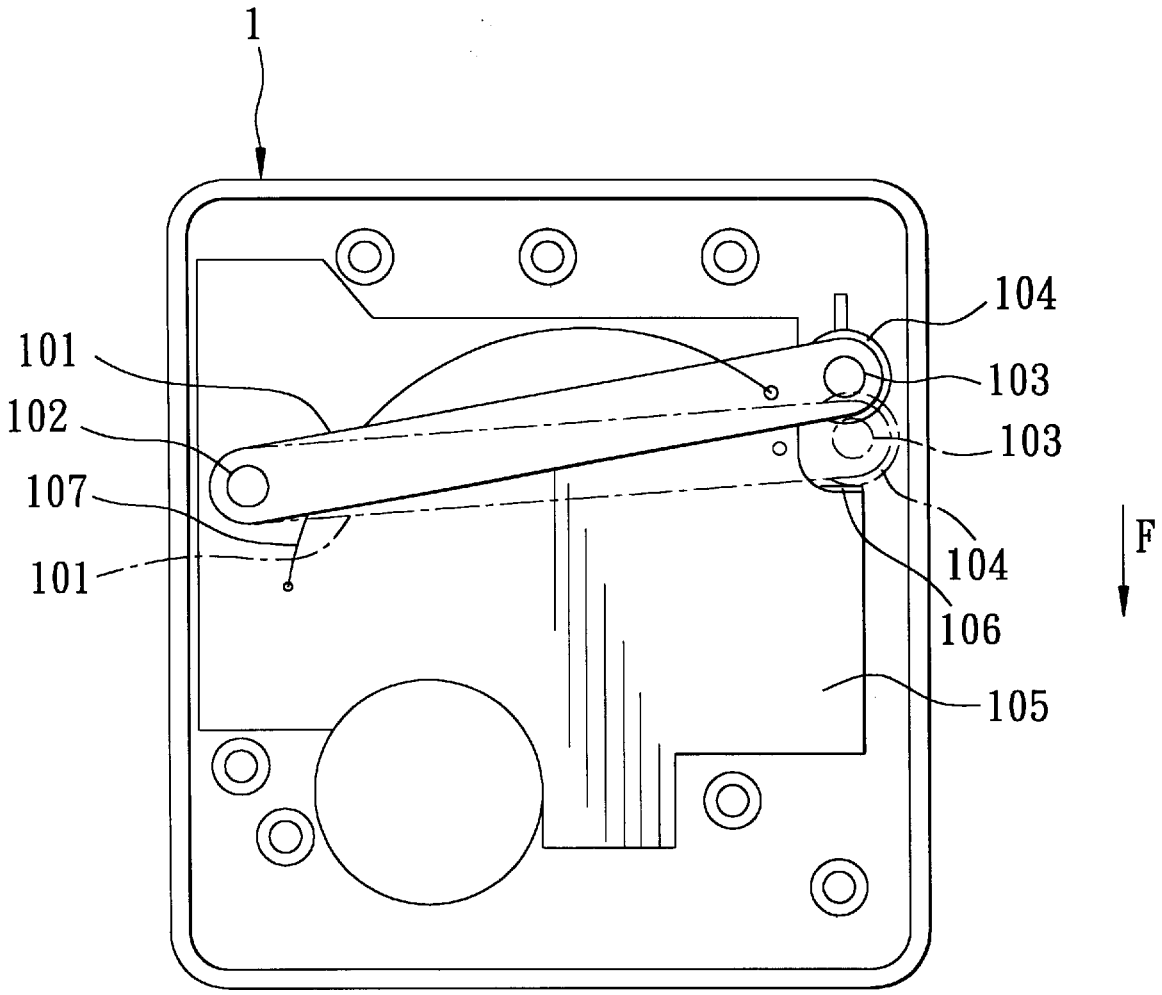
FIG. 1 PRIOR ART
FIG. 1 is a schematic view of a conventional vibration switch.
Figure 2:
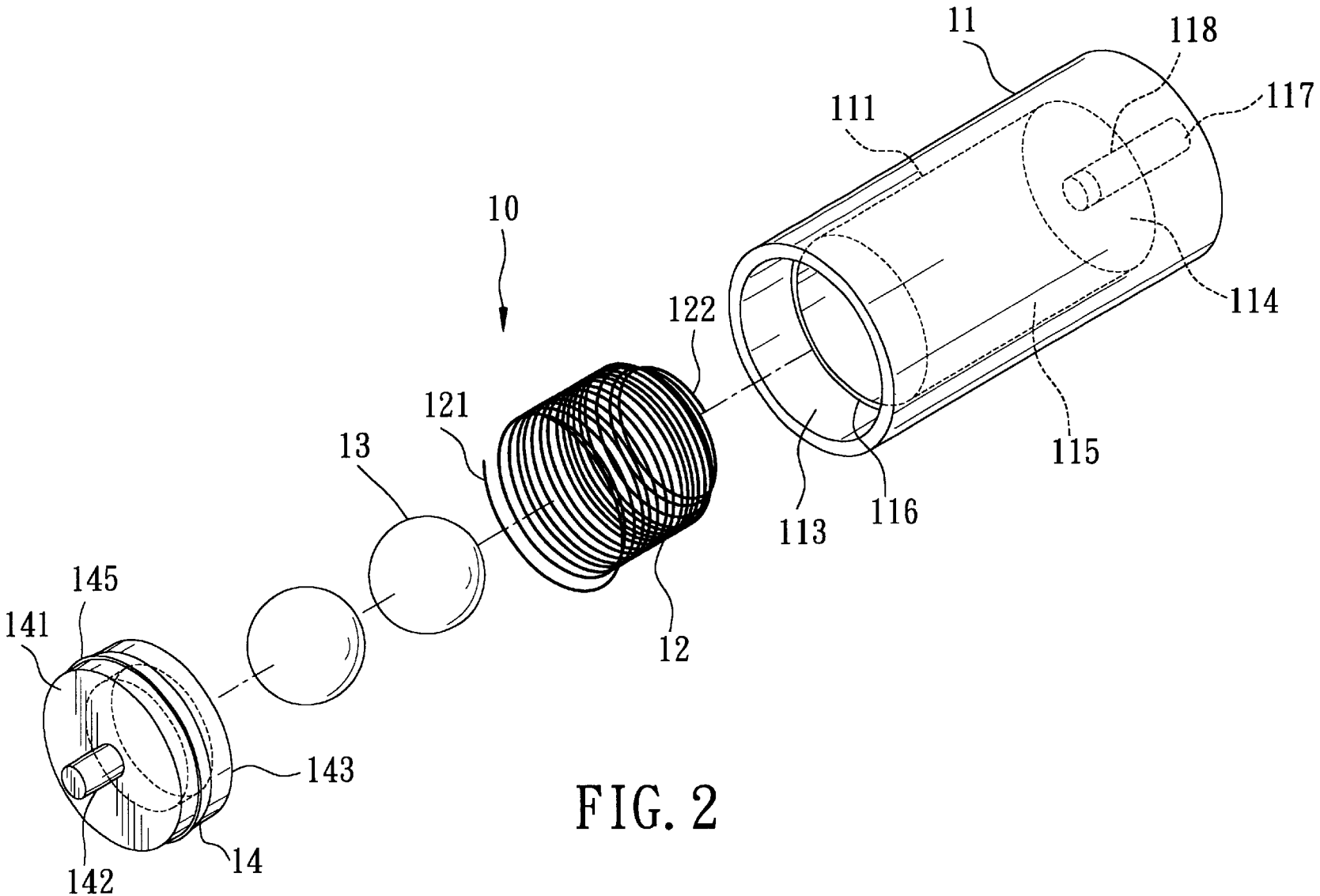
FIG. 2 is an exploded perspective view of the first preferred embodiment of a vibration switch according to this invention.
Figure 3:
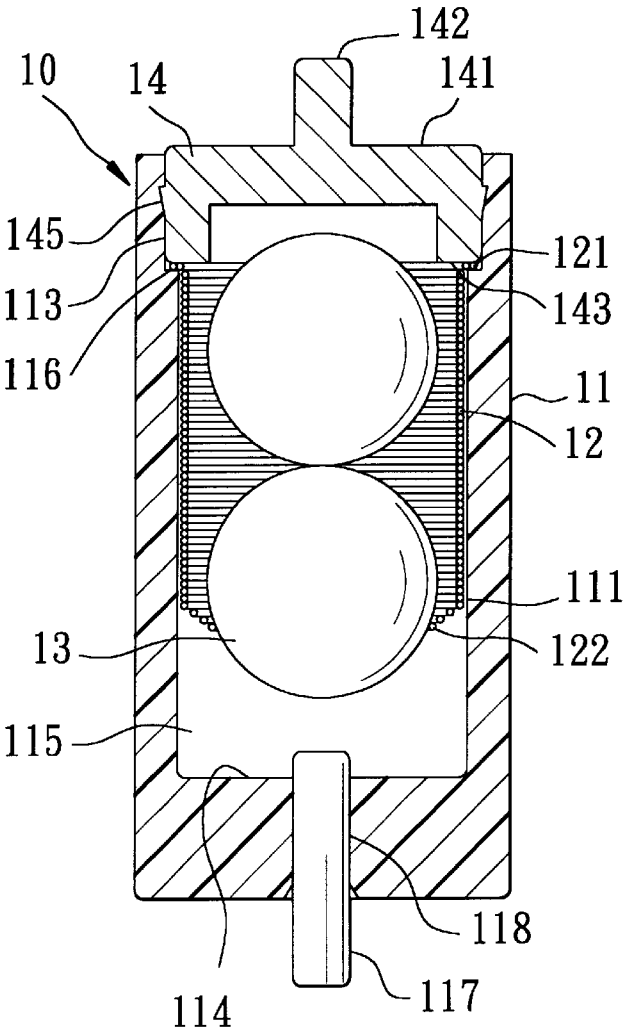
FIG. 3 is a sectional view of the first preferred embodiment.

Referring to FIGS. 2 and 3, the first preferred embodiment of a vibration switch 10 according to the present invention is shown to comprise an elongate housing 11, two ball-shaped electrically conductive contact bodies 13, an electrically conductive biasing member 12, and a plug member 14.

The housing 11 is adapted to be mounted on a support (not shown) in an upright direction, and is made from an insulating material. The housing 11 has a lower inner wall surface 114 and a surrounding wall 111, which cooperatively confine an accommodation chamber 115 with an upper opening end 113. The surrounding wall 111 is formed with a shoulder 116 adjacent to the upper opening end 113.

The plug member 14 is made from an electrically conductive material, and has a top surface 141 which is formed with an electric contact terminal 142 extending upwardly therefrom, and a surrounding wall with an annular guiding protrusion 145 for facilitating fitting insertion of the surrounding wall into the upper opening end 113 such that a lower surface 143 of the plug member 14 abuts against the shoulder 116 to close the upper opening end 113.

The contact bodies 13 are disposed in the accommodation chamber 13, and are superimposed upon each other in the upright direction so as to define uppermost and lowermost ends which are opposite to each other in the upright direction and which are proximate to the upper opening end 113 and the lower inner wall surface 114, respectively. The contact bodies 13 are movable together in the upright direction.

In this embodiment, the biasing member 12 is a tension coil spring, and has an engaging end 121 which engages the lower surface 143 when the lower surface 143 abuts against the shoulder 116 and which is in the form of a loop with a first dimension so as to permit the contact bodies 13 to pass therethrough, and a holding end 122 which is in the form of a loop with a second dimension that is smaller than the first dimension so as to hold the contact bodies 13.

An electric contact member 117 is disposed to extend into the accommodation chamber 115 via a through hole 118 in the housing 11 to cooperate with the electric contact terminal 142 to form a switch unit.

Figure 4:
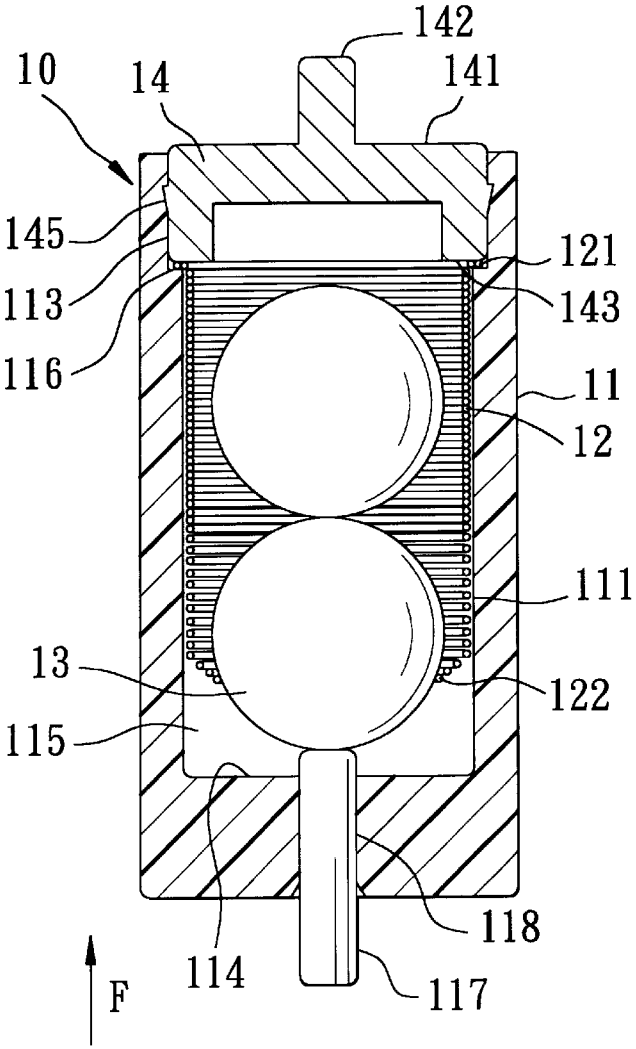
FIG. 4 is a sectional view of the first preferred embodiment when vibrated.

By means of a biasing action of the coil spring 12 against the weight of the electric contact bodies 13, the holding end 122 can restrain the lowermost end of the electric contact bodies 13 from moving towards the contact member 117 so as to break an electrical connection between the contact terminal 142 and the contact member 117, thereby placing the switch in an off state. As shown in FIG. 4, once the housing 11 is jerked to move upwards by means of a force (F), the contact bodies 13 will move downwards as a result of an inertial force of the contact bodies 13 so as to contact with the contact member 117, thereby making the electrical connection between the contact terminal 142 and the contact member 117.

As illustrated, the vibration switch of this invention has a simple construction that is easy to fabricate at a relatively low manufacturing cost and that has a compact size to facilitate carrying.

Figure 6:
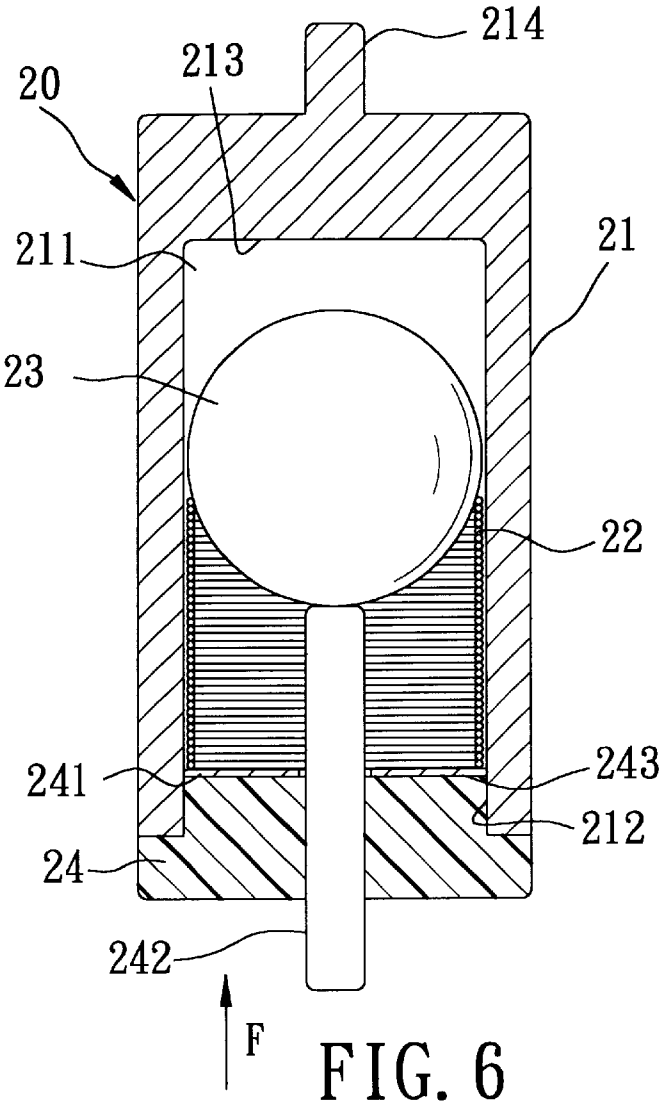
FIG. 6 is a sectional view of the second preferred embodiment when vibrated.
Figure 5:
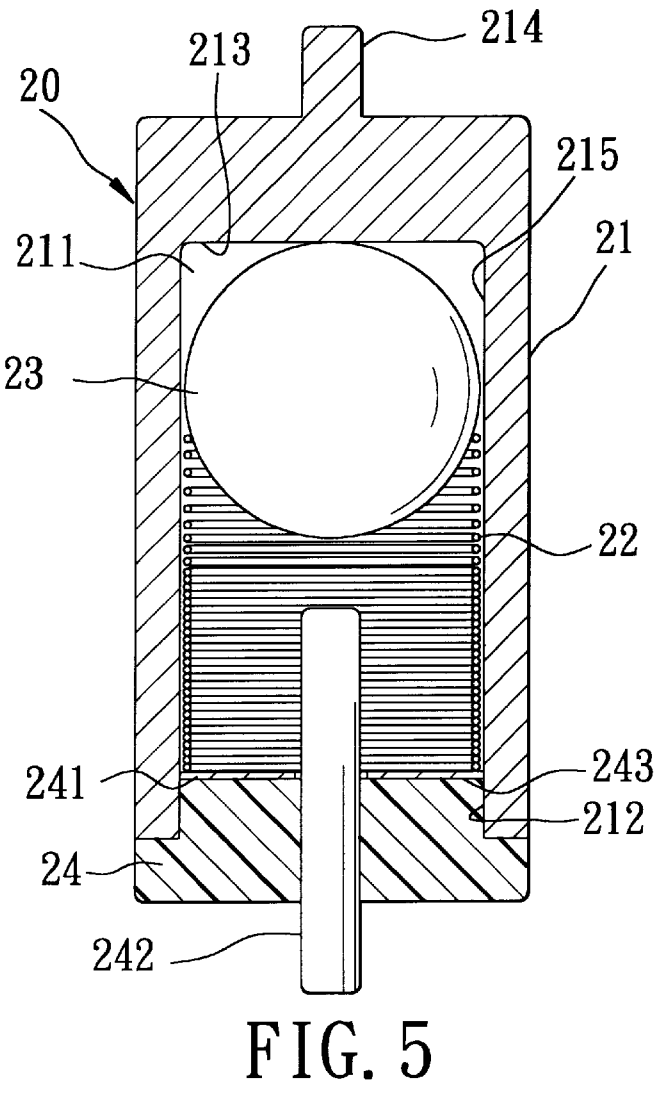
FIG. 5 is a sectional view of the second preferred embodiment of a vibration switch of this invention.

Referring to FIGS. 5 and 6, the second preferred embodiment of a vibration switch 20 is shown to include an electrically conductive housing 21, an insulating plug 24, a ball-shaped electrically conductive contact body 23, and an electrically conductive biasing member 22. The housing 21 has an upper inner wall surface 213 and a surrounding wall 215, which cooperatively confine an accommodation chamber 211 with a lower opening end 212. An electrically contact terminal 214 is integrally formed with and extends upwardly of the upper inner wall surface 213. The plug 24 is fittingly inserted into the lower opening end 212, and has an electrically conductive plate member 241 which is mounted on an end wall surface 243 thereof. An electric contact member 242 extends through the plug 24, and passes insulatingly through the plate member 241 into the accommodation chamber 211. The biasing member 22 is a compression coil spring and is in a loop form to permit the contact member 242 to pass therethrough. The biasing member 22 has an engaging end which engages the plate member 241, and a holding end which holds and which biases the contact body 23 to abut against the upper inner wall surface 213 so as to restrain the lowermost end of the contact body 23 from moving toward the contact member 242, thereby breaking the electrical connection between the contact terminal 214 and the contact member 242. Once the housing 21 is jerked to move upwards by means of a force (F), the contact body 23 will move downwards as a result of an inertial force of the contact body 23 so as to contact with the contact member 242, thereby making the electrical connection between the contact terminal 214 and the contact member 242.

Figure 8:
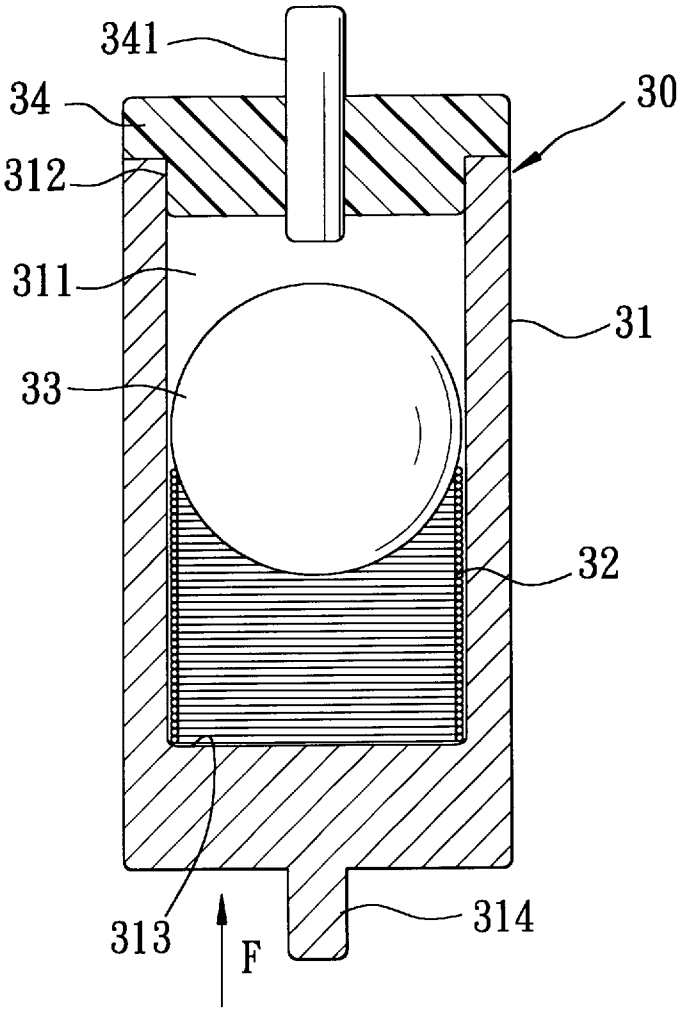
FIG. 8 is a sectional view of the third preferred embodiment when vibrated.
Figure 7:
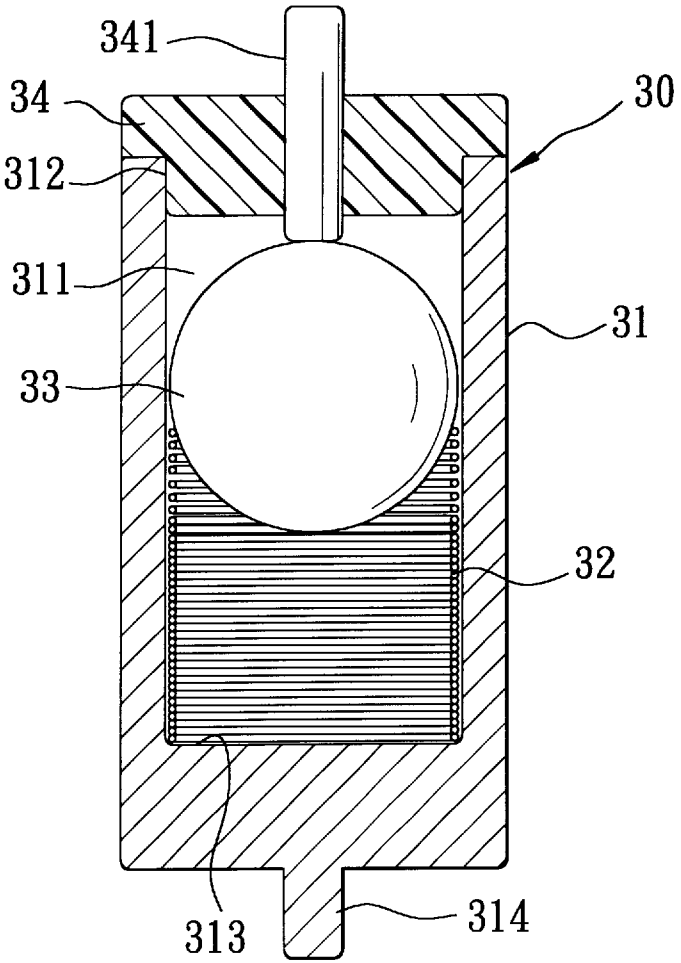
FIG. 7 is a sectional view of the third preferred embodiment of a vibration switch of this invention.

Referring to FIGS. 7 and 8, the third preferred embodiment of a vibration switch 30 is shown to include an electrically conductive housing 31, an insulating plug 34, a ball-shaped electrically conductive contact body 33, and an electrically conductive biasing member 32. The housing 31 confines an accommodation chamber 311 with an upper opening end 312 for fitting insertion of the plug 34. An electric contact member 341 extends through the plug 34 into the accommodation chamber 311. An electric contact terminal 314 extends downwardly of and is formed integrally with a lower inner wall surface 313 of the housing 31. The biasing member 32 is a compression coil spring and is in a looped form. The biasing member 32 has an engaging end which engages the lower inner wall surface 313, and a holding end which holds and biases an uppermost end of the contact body 33 to abut against the contact member 341 so as to make the electrical connection between the contact terminal 314 and the contact member 341. Once the housing 31 is jerked to move upwards, the contact body 33 will move downwards to disengage from the contact member 341, thereby breaking the electrical connection between the contact terminal 314 and the contact member 341.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A vibration switch comprising:

a housing mounted on a support in an upright direction, and having upper and lower inner wall surfaces spaced apart from each other in the upright direction, and a surrounding wall interposed between and cooperating with said upper and lower inner wall surfaces to confine an accommodation chamber;

an electric contact body disposed in said accommodation chamber and movable in the upright direction, said electric contact body having electrically conductive uppermost and lowermost ends opposite to each other in the upright direction;

a biasing member having an engaging end disposed to engage one of said upper and lower inner wall surfaces, and a holding end opposite to said engaging end and disposed to hold said electric contact body such that said uppermost and lowermost ends are nearest to said upper and lower inner wall surfaces respectively, and such that by means of a biasing action against weight of said electric contact body, said holding end restrains said electric contact body from moving towards said lower inner wall surface; and a switching unit including a contact member disposed to extend into said accommodation chamber such that said switching unit is placed in one of switch-on and switch-off states in response to movement of said electric contact body in the upright direction relative to said contact member as a result of an inertial force of said electric contact body when said housing is jerked to move upwards, wherein said electric contact body is in ball shape, and is made of an electrically conductive material, wherein said biasing member is made from an electrically conductive material, one of said upper and lower inner wall surfaces having an electrically conductive portion formed thereon, and the other one of said upper and lower inner wall surfaces having an insulating portion formed thereon, said engaging end of said biasing member engaging said electrically conductive portion, said switching unit including an electric contact terminal which is formed integrally with said electrically conductive portion and which extends outwardly of said accommodation chamber, said contact member extending through said insulating portion into said accommodation chamber such that, by virtue of an electrical connection between said contact terminal and said contact member, the movement of said electric contact body to contact with said contact member will place said switching unit in the switch-on state, and wherein said upper and lower inner wall surfaces are respectively made from electrically conductive and insulating materials, and said surrounding wall is made of an insulating material, said biasing member being a tension coil spring, said engaging end engaging said upper inner wall surface and being in a looped form having a first dimension so as to permit said electric contact body to pass therethrough, said holding end being in a looped form having a second dimension smaller than the first dimension so as to hold said electric contact body, said tension coil spring having a strength such that said tension coil spring restrains said lowermost end of said electric contact body from moving towards said contact member so as to break an electrical connection between said contact terminal and said contact member, and such that, once said housing is jerked to move upwards, said electric contact body will move downwards to contact with said contact member so as to make the electrical connection between said contact terminal and said contact member.

2. A vibration switch comprising:

a housing mounted on a support in an upright direction, and having upper and lower inner wall surfaces spaced apart from each other in the upright direction, and a surrounding wall interposed between and cooperating with said upper and lower inner wall surfaces to confine an accommodation chamber;

an electric contact body disposed in said accommodation chamber and movable in the upright direction, said electric contact body having electrically conductive uppermost and lowermost ends opposite to each other in the upright direction;

a biasing member having an engaging end disposed to engage one of said upper and lower inner wall surfaces, and a holding end opposite to said engaging end and disposed to hold said electric contact body such that said uppermost and lowermost ends are nearest to said upper and lower inner wall surfaces respectively, and such that by means of a biasing action against weight of said electric contact body, said holding end restrains said electric contact body from moving towards said lower inner wall surface; and a switching unit including a contact member disposed to extend into said accommodation chamber such that said switching unit is placed in one of switch-on and switch-off states in response to movement of said electric contact body in the upright direction relative to said contact member as a result of an inertial force of said electric contact body when said housing is jerked to move upwards, wherein said electric contact body is in ball shape, and is made of an electrically conductive material; and wherein said biasing member is made from an electrically conductive material, one of said upper and lower inner wall surfaces having an electrically conductive portion formed thereon, and the other one of said upper and lower inner wall surfaces having an insulating portion formed thereon, said engaging end of said biasing member engaging said electrically conductive portion, said switching unit including an electric contact terminal which is formed integrally with said electrically conductive portion and which extends outwardly of said accommodation chamber, said contact member extending through said insulating portion into said accommodation chamber such that, by virtue of an electrical connection between said contact terminal and said contact member, the movement of said electric contact body to contact with said contact member will place said switching unit in the switch-on state, and wherein said lower inner wall surface and said surrounding wall are made from an electrically conductive material and are integrally formed, and said upper inner wall surface is made of an insulating material, said contact member extending through said upper inner wall surface into said accommodation chamber, said biasing member being a compression coil spring, said engaging end engaging said lower inner wall surface, said holding end being in a looped form to hold said electric contact body, said compression coil spring having a strength such that said spring biases said electric contact body to abut against said contact member so as to restrain said uppermost end from disengaging from said contact member so as to make an electrical connection between said contact terminal and said contact member, and such that, once said housing is jerked to move upwards, said electric contact body will move downwards to disengage from said contact member so as to break the electrical connection between said contact terminal and said contact member.

* * * * *